US005515962A

United States Patent [19]

Kennedy et al.

[11] Patent Number: 5,515,962

[45] Date of Patent: May 14, 1996

[54] ICE CREAM SANDWICH COLLATOR SUB-ASSEMBLY

[75] Inventors: Cory R. Kennedy; Yancey Grubzak, both of Richmond, Va.

[73] Assignee: Interbake Foods, Inc., Richmond, Va.

[21] Appl. No.: 473,049

[22] Filed: Jun. 7, 1995

Related U.S. Application Data

[63] Continuation of Ser. No. 318,922, Oct. 6, 1994, abandoned.

[51] Int. Cl.[6] ..... A21C 9/04; A21C 15/00; B65G 25/00; B65G 29/00

[52] U.S. Cl. ..... 198/430; 99/450.4; 99/484; 198/468.1; 198/746

[58] Field of Search ..... 99/450.1, 450.4, 99/450.7, 484, 494; 198/430, 468.1, 746; 53/152, 154, 222–232; 414/791.6, 790.9, 795.3, 790.3, 794.7

[56] References Cited

U.S. PATENT DOCUMENTS

| | | | |
|---|---|---|---|
| 2,639,677 | 5/1953 | Anderson | 99/450.4 |
| 2,794,404 | 6/1957 | Rapp | 99/450.4 |
| 2,923,257 | 2/1960 | Monaco | 99/450.4 |
| 3,119,352 | 1/1964 | Roehn, Jr. | 99/450.4 |
| 3,119,353 | 1/1964 | Roehn, Jr. | 99/450.4 |
| 3,316,860 | 5/1967 | Peterson | 99/450.4 |
| 3,622,017 | 11/1971 | Meuller | 414/791.6 |
| 3,834,119 | 9/1974 | Armitt et al. | 53/230 |
| 3,954,165 | 5/1976 | Snyder | 53/152 |
| 4,078,362 | 3/1978 | Ellis | 53/222 |
| 4,081,945 | 4/1978 | Calvert | 53/566 |
| 4,348,853 | 9/1982 | Morse et al. | 53/566 |
| 4,448,012 | 3/1984 | Kauffman et al. | 53/563 |
| 4,537,121 | 8/1985 | Bero et al. | 99/450.4 |
| 4,584,933 | 4/1986 | Price | 99/450.4 |
| 4,612,852 | 9/1986 | Price et al. | 99/450.4 |
| 4,628,664 | 12/1986 | Price | 53/232 |
| 4,751,878 | 6/1988 | Lopes | 99/450.1 |
| 4,989,720 | 2/1991 | Price et al. | 198/430 |
| 5,042,638 | 8/1991 | Price | 198/430 |
| 5,261,522 | 11/1993 | Guttinger et al. | 198/430 |

*Primary Examiner*—Timothy F. Simone
*Attorney, Agent, or Firm*—Klauber & Jackson

[57] ABSTRACT

An ice cream sandwich collating apparatus comprising a substantially horizontal accumulator platform; conveying means for conveying the ice cream sandwiches along a first substantially horizontal axis onto the accumulator platform; detecting means for detecting when a predetermined number of the conveyed ice cream sandwiches have accumulated on the accumulator platform; an elevator assembly disposed adjacent the accumulator platform, the elevator assembly having a substantially horizontal elevator platform that is movable along a substantially vertical axis; mounting means disposed above the accumulator platform, the mounting means being movable along a second substantially horizontal axis between a beginning position and an ending position, the second horizontal axis being substantially transverse to the first horizontal axis; pushing means mounted to the mounting means so as to be freely pivotally movable between a vertical position and a horizontal position, the pushing means assuming the vertical position for pushing the predetermined number of conveyed ice cream sandwiches from the accumulator platform onto the elevator platform when the mounting means moves forward from the beginning position to the ending position, the pushing means assuming the horizontal position for either passing or sliding over any additionally accumulated ice cream sandwiches when the mounting means moves backward from the ending position to the beginning position; and control means for controlling the horizontal movement of the mounting means and the vertical movement of the elevator platform.

30 Claims, 9 Drawing Sheets

ICE CREAM SANDWICH COLLATOR SUB-ASSEMBLY

This Application is a Continuation of application Ser. No. 08/318,922, filed Oct. 6, 1994, now abandoned.

FIELD OF INVENTION

The present invention relates generally to apparatus for collating articles for packaging and, more particularly, to an apparatus for collating wrapped ice cream sandwiches for packaging.

BACKGROUND OF THE INVENTION

In the initial state of the art, after an ice cream sandwich was wrapped, it was placed on a conveyor belt with other wrapped ice cream sandwiches and serially moved along on the conveyor belt. The conveyor belt terminated at a dead plate onto which the ice cream sandwiches were deposited. As each wrapped ice cream sandwich was deposited on the dead plate, it would push the ice cream sandwiches already on the dead plate further therealong. The wrapped ice cream sandwiches would then be pushed off the dead plate onto a pair of pivoted wing plates. When a predetermined number of wrapped ice cream sandwiches, for example, three or four, were pushed onto the wing plates, the conveyor operation was stopped, and the wing plates were opened up so as to drop the wrapped ice cream sandwiches thereon onto a platform, the dropped ice cream sandwiches then being pushed by a pusher bar into a box for packaging.

However, the above-described arrangement provided distinct disadvantages. In the first place, the distance that the wrapped ice cream sandwiches had to travel from the dead plate onto the wing plates was an extra 12 to 14 inches. Because of such distance, the amount of time necessary for collating the wrapped ice cream sandwiches would add cost and time to the operation and/or mis-operation. In addition, when the wing plates opened to drop the wrapped ice cream sandwiches onto the lower platform, the wrapped ice cream sandwiches would sometimes tilt or deflect or would get caught on the wing plates, which would cause further delay in the operation and/or mis-operation. A third problem that resulted with such arrangement was that a four and one-half inch clearance between the lower platform and the surface of the closed wing plates was generally necessary in order to provide clearance for the opening of the wing plates. Because the ice cream sandwiches dropped such a great distance, there was more apt to be problems with misalignment and the like, and there was further delay involved. Lastly, there was a further delay in the operation since the conveyor belt could not begin movement to push more wrapped ice cream sandwiches onto the wing plate until the wing plates had closed.

Accordingly, the above-described arrangement provided distinct disadvantages in the collating of wrapped ice cream sandwiches for packaging.

An effort was made to overcome the disadvantages of the above-described arrangement in U.S. Pat. No. 5,042,638 to Price. Price discloses an ice cream sandwich collating apparatus comprising a substantially flat plate; conveying means for conveying the ice cream sandwiches in a first direction onto the flat plate; detector means for detecting when a predetermined number of the ice cream sandwiches have been conveyed onto the flat plate; an infeed chute positioned below the flat plate; pusher means for pushing the predetermined number of ice cream sandwiches in a second direction from the flat plate onto the infeed chute so as to collate the pushed ice cream sandwiches, the second direction being substantially transverse to the first direction; mounting means for freely pivotally mounting the pusher means above the flat plate for movement in the second direction between a start position and an end position; and control means for controlling the movement of the pusher means from the start position to the end position so as to move the ice cream sandwiches from the flat plate onto the infeed chute, and for controlling the movement of the pusher means back from the end position to the start position in a manner to permit the pusher means to be deflected so as not to obstruct the conveyance of subsequent incoming ice cream sandwiches onto the flat plate during movement of the pusher means from the end position to the start position.

While Price addressed several of the disadvantages of the above-described arrangement, a disadvantage still remains with respect to transferring the ice cream sandwiches from the flat plate onto the infeed chute. As previously discussed, the dropping of the ice cream sandwiches can result in misalignment and the like. Also, damage may occur in the sandwiches if the dropping force is too great.

Accordingly, it is desirable to overcome the disadvantage of the present commercial method which includes transferring the ice cream sandwiches from the flat plate onto the infeed chute.

SUMMARY OF THE INVENTION

The present invention contemplates an apparatus for collating wrapped ice cream sandwiches for packaging wherein an elevator assembly is utilized so as to obviate the need to drop the wrapped ice cream sandwiches in the collating operation.

The present invention ice cream sandwich collating apparatus comprises a substantially horizontal accumulator platform; conveying means for conveying the ice cream sandwiches along a first substantially horizontal axis onto the accumulator platform; detecting means for detecting when a predetermined number of the conveyed ice cream sandwiches have accumulated on the accumulator platform; an elevator assembly disposed adjacent the accumulator platform, the elevator assembly having a substantially horizontal elevator platform that is movable along a substantially vertical axis; mounting means disposed above the accumulator platform, the mounting means being movable along a second substantially horizontal axis between a beginning position and an ending position, the second horizontal axis being substantially transverse to the first horizontal axis; pushing means mounted to the mounting means for pushing a predetermined number of conveyed ice cream sandwiches from the accumulator platform onto the elevator platform when the mounting means moves forward from the beginning position to the ending position; and control means for controlling the horizontal movement of the mounting means and the vertical movement of the elevator platform.

More particularly, the pushing means is adapted to be freely pivotably movable between a vertical position and a substantially horizontal position. The pushing means assumes the vertical position to push the conveyed ice cream sandwiches from the accumulator platform onto the elevator platform when the mounting means moves forward from the beginning position to the ending position. The pushing means is also capable of deflecting toward the horizontal position for either passing or making sliding contact with any additionally accumulated ice cream sandwiches while riding over said ice cream sandwiches when the mounting means moves backward from the ending position to the beginning position.

The conveying means is width-adjustable so as to allow ice cream sandwiches of differing widths to be conveyed onto the accumulator platform.

The accumulator platform is length-adjustable so as to allow differing predetermined numbers of conveyed ice cream sandwiches to accumulate on the accumulator platform.

The elevator assembly is level-adjustable so as to allow differing numbers of layers of ice cream sandwiches to be stacked on the elevator platform.

The control means may also control the conveying speed of the conveying means.

Accordingly, the primary object of the present invention to provide an apparatus for collating wrapped ice cream sandwiches for packaging wherein an elevator assembly is utilized so as to obviate the need to drop the wrapped ice cream sandwiches in the collating operation.

The above primary object, as well as other objects, features, and advantages, of the present invention will become readily apparent from the following detailed description which is to be read in conjunction with the appended drawings.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF A PREFERRED EMBODIMENT

Figure 1:
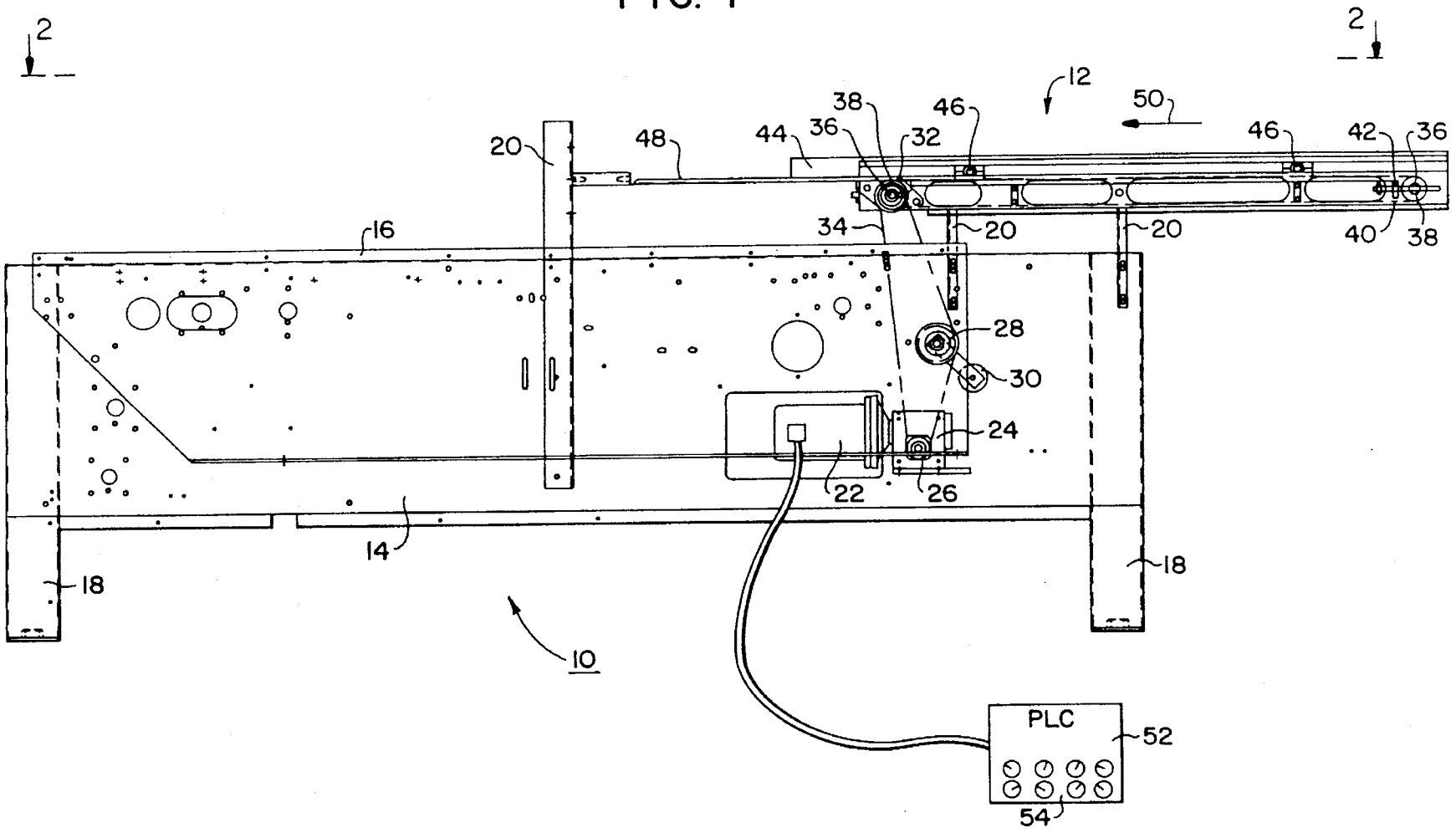
FIG. 1 is a side view of part of the frame of an ice cream sandwich collating and packaging machine along with an adjustable conveyor assembly according to the present invention attached thereto.
Figure 2:
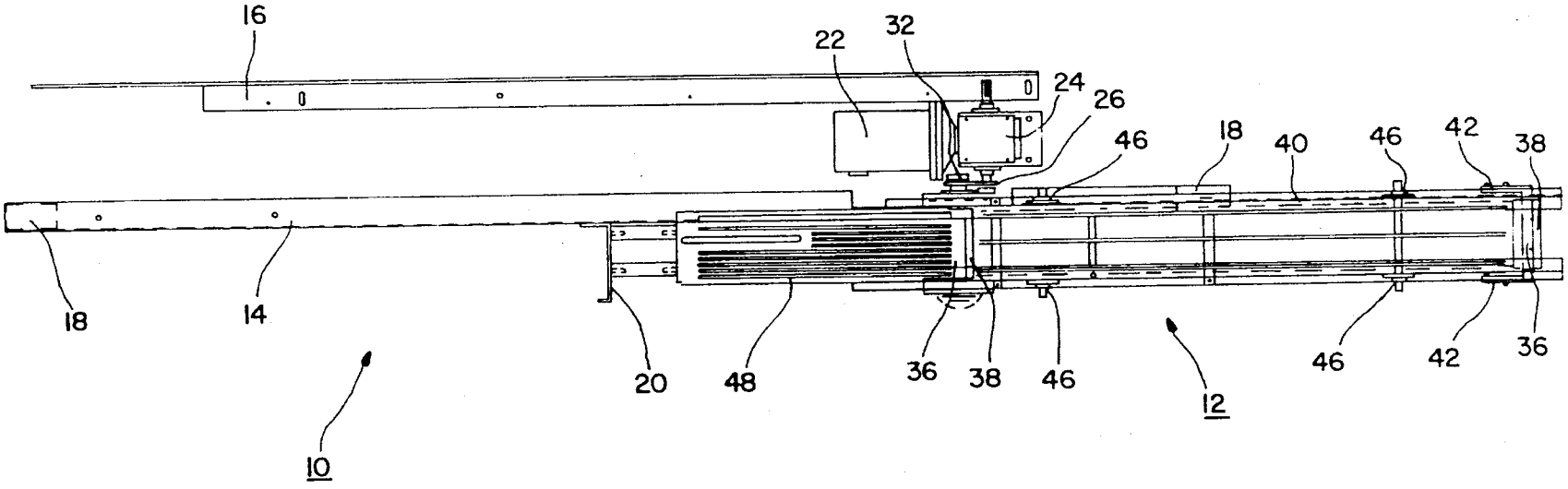
FIG. 2 is a top view of the frame and the adjustable conveyor assembly shown in FIG. 1 taken along line 2—2 of FIG. 1.
Figure 3:
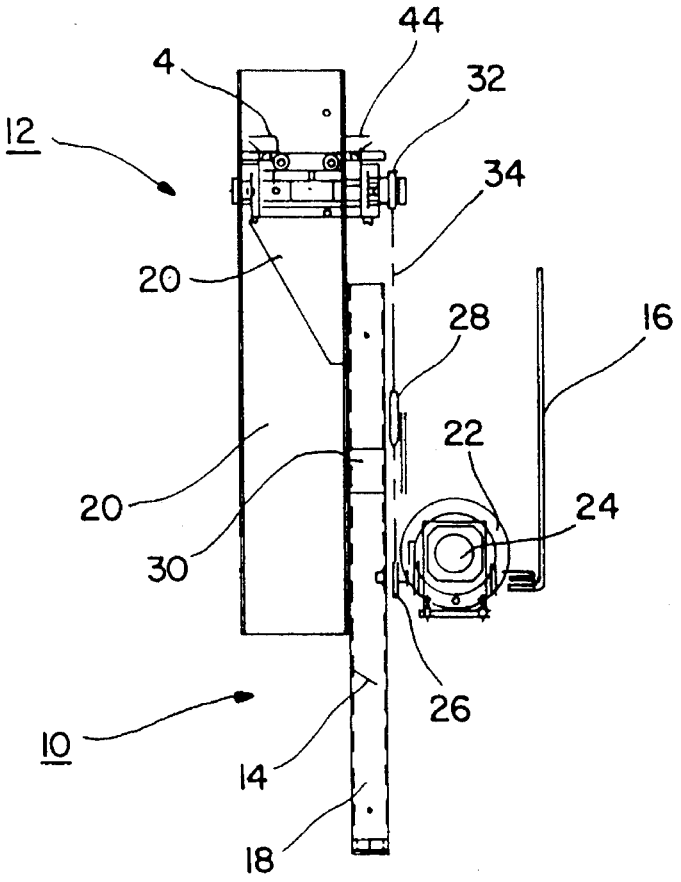
FIG. 3 is an end view of the frame and the adjustable conveyor assembly shown in FIG. 1 taken along line 3—3 of FIG. 2.

Referring to FIGS. 1–3, there are shown a side view, a top view, and an end view, respectively, of part of the frame 10 of an ice cream sandwich collating and packaging machine along with an adjustable conveyor assembly 12 according to the present invention attached thereto. The part of the frame 10 shown comprises a frame panel 14, a stationary strongback 16, a pair of frame legs 18, and a plurality of frame brackets 20. The adjustable conveyor assembly 12 comprises a DC motor 22, a reducer 24, an input sprocket 26, an idler sprocket 28, a chain tensioner 30, an output sprocket 32, a drive chain 34, a pair of spindles 36, a pair of rollers 38, a conveyor belt 40, a belt tensioner 42, a pair of guide rails 44, guide rail width adjustment means 46, and an accumulator platform 48.

The function of the adjustable conveyor assembly 12 is to convey ice cream sandwiches along a first substantially horizontal axis 50 onto the accumulator platform 48. The accumulator platform 48 and the pair of guide rails 44 are secured to a frame 10 through the plurality of frame brackets such as brackets 20. The conveyor belt 40 is draped around the pair of rollers 38, which rollers are mounted on the pair of spindles 36. The belt tensioner 42 comprises a pair of tensioner bolts 42 which are integral with the input end spindle 36. The tensioner bolts 42 may be tightened or loosened so as to adjust the tension of the conveyor belt 40.

The guide rails 44 are width-adjustable across the conveyor belt 40 via the guide rail width adjustment means 46. The guide rail width adjustment means 46 comprises a pair of shafts passing between the guide rails 44 and a set screw collar arrangement disposed on the ends of each shaft. The guide rails 44 are width-adjustable so as to allow ice cream sandwiches of differing widths to be conveyed between the guide rails 44 along the conveyor belt 40 and onto the accumulator platform 48.

The conveyor belt 40 is driven via the DC motor 22, the speed of which may be controlled as by a programmable logic controller (PLC) 52 which provides a control panel 54 for allowing a user to interface therewith. The DC motor 22 provides a torque output which is reduced at a ratio of 30:1 by the reducer 24, which is typically a Dayton reducer. The reducer 24 provides the reduced torque output at the input sprocket 26 which is linked to the idler sprocket 28 and the output sprocket 32 by the drive chain 34. The tension in the drive chain 34 is adjusted by the chain tensioner 30, which typically may be a Rosta tensioner. The output sprocket 32 is coupled directly to the drive end spindle 36 so as to drive the conveyor belt 40. It should be noted that the control panel 54 allows a user to adjust the conveying speed of the conveyor belt 40.

Figure 4:
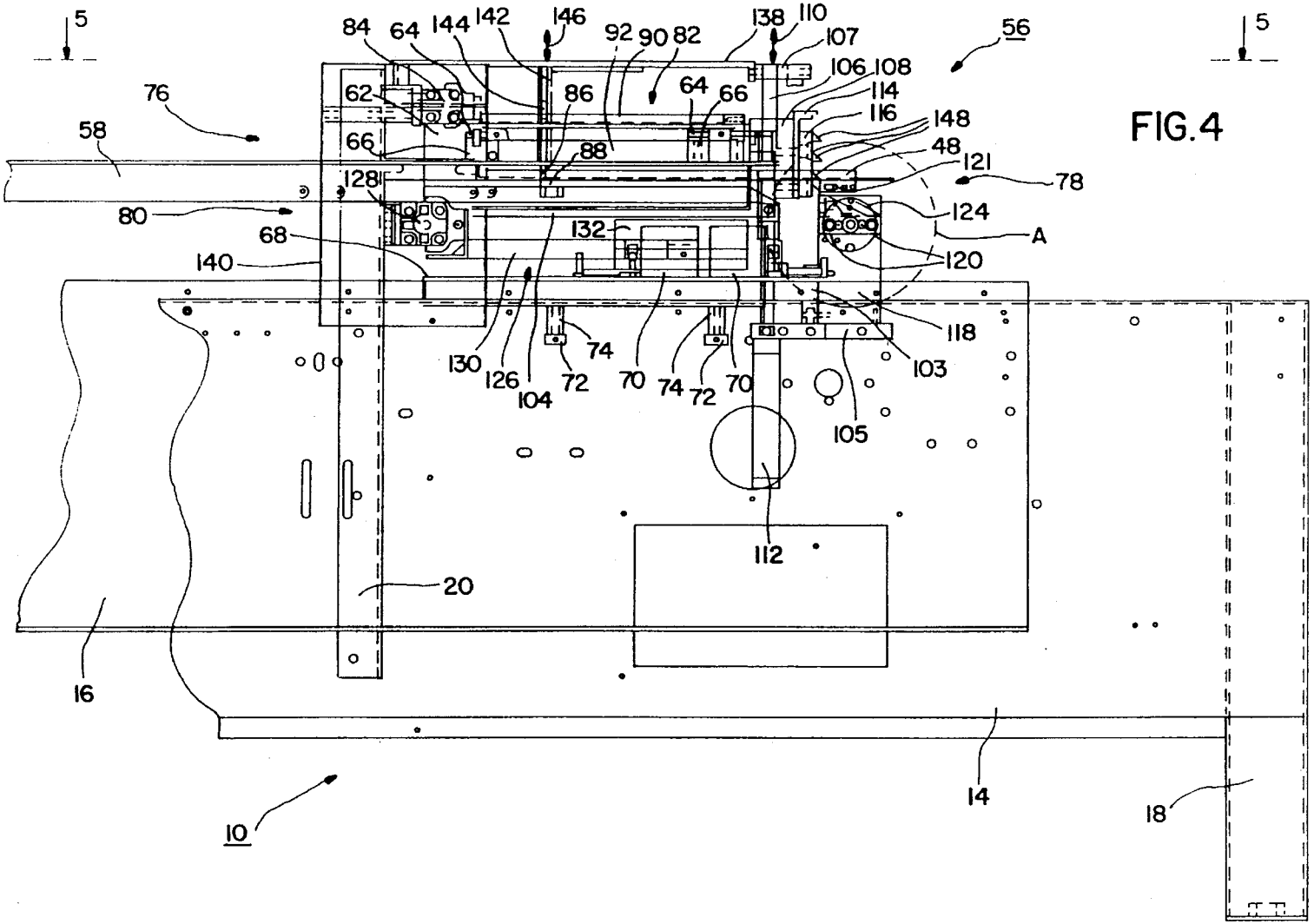
FIG. 4 is a side view of part of the frame of an ice cream sandwich collating and packaging machine along with an adjustable loader assembly according to the present invention attached thereto.
Figure 5:
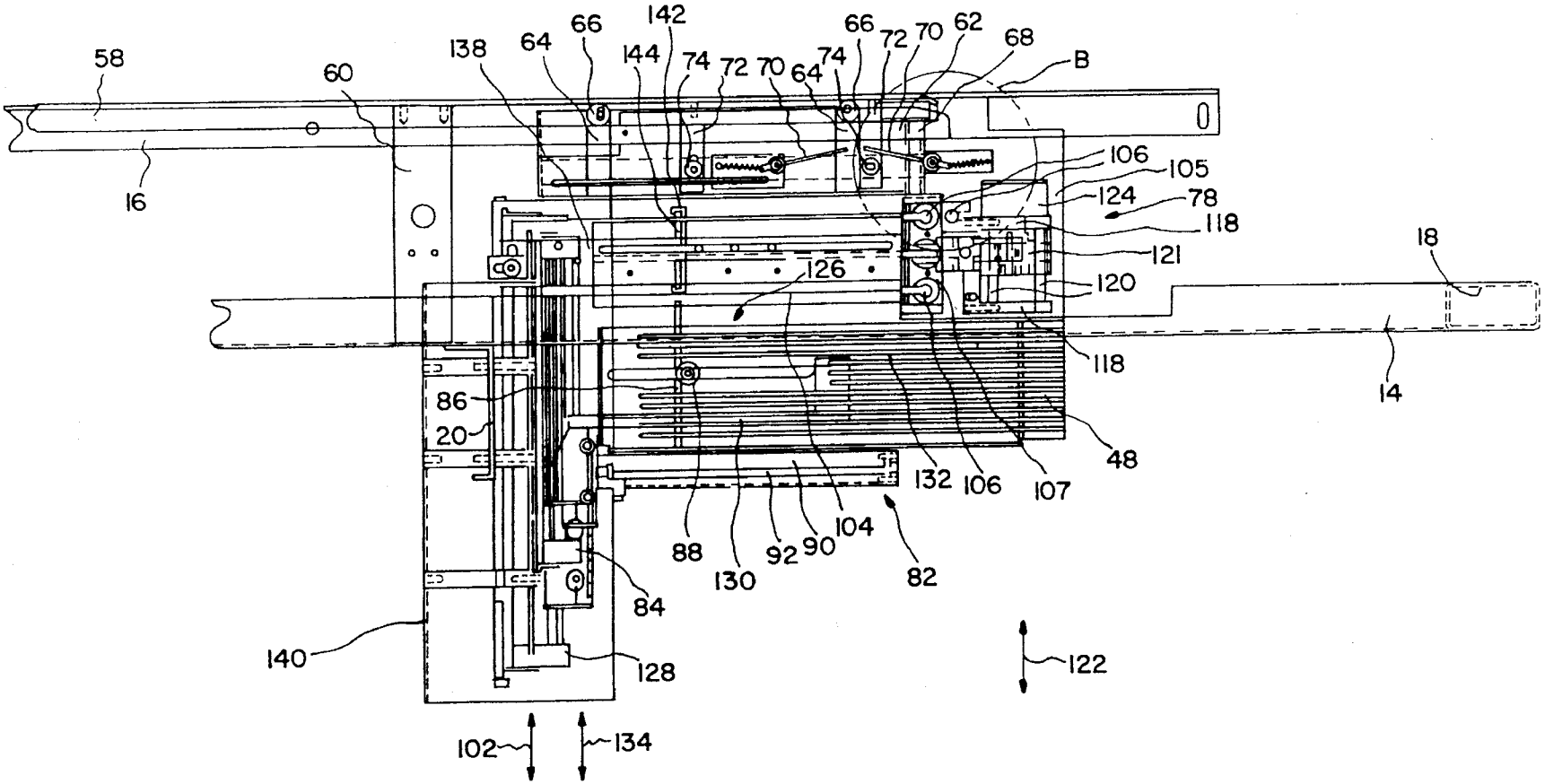
FIG. 5 is a top view of the frame and the adjustable loader assembly shown in FIG. 4 taken along line 5—5 of FIG. 4.
Figure 6:
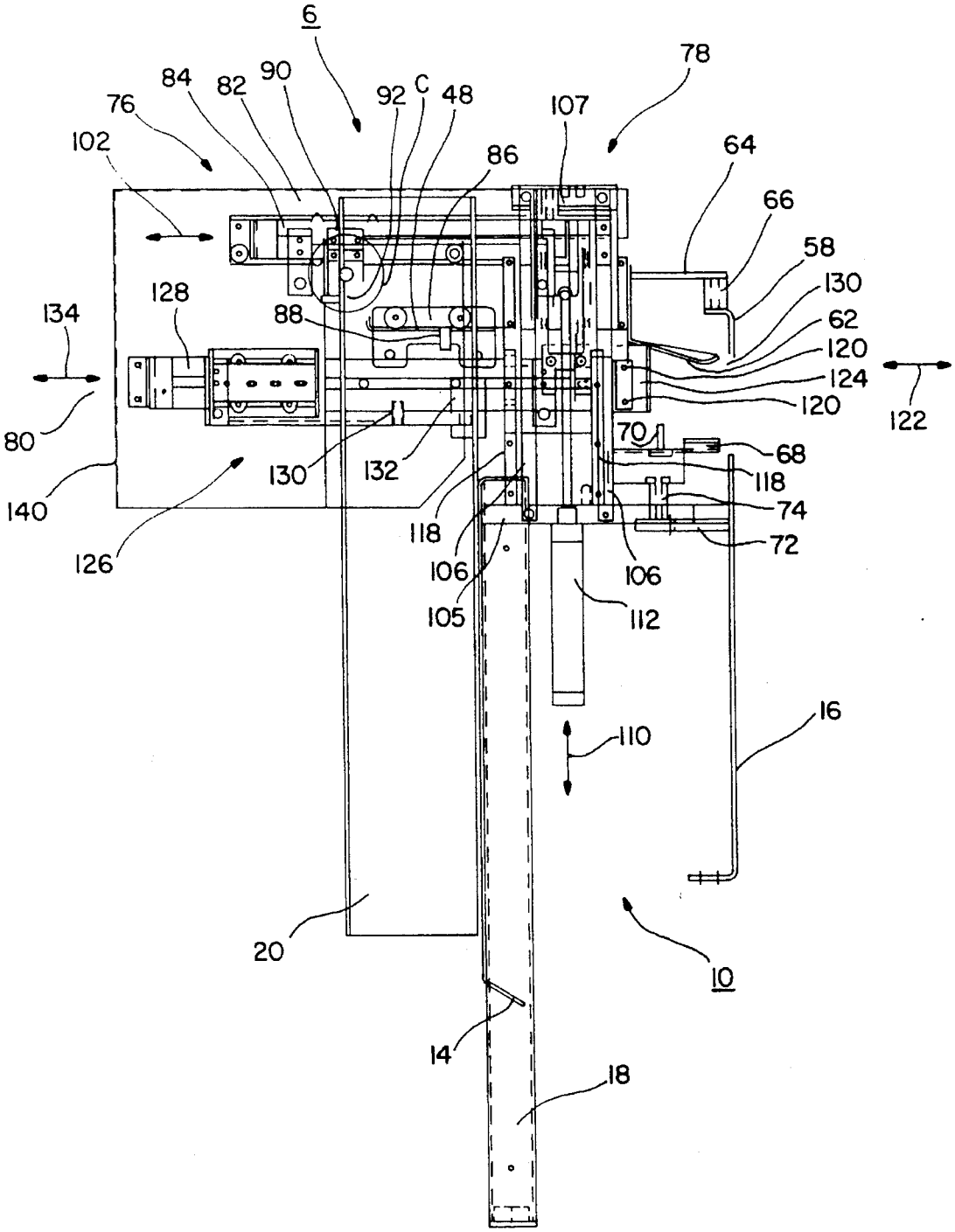
FIG. 6 is an end view of the frame and the adjustable loader assembly shown in FIG. 4 taken along line 6—6 of FIG. 5.

Referring to FIGS. 4–6, there are shown a side view, a top view, and an end view, respectively, of the part of the frame 10 of the ice cream sandwich collating and packaging machine shown in FIGS. 1–3 along with an adjustable loader assembly 56 according to the present invention attached thereto. All of the components of the adjustable conveyor assembly 12, except the accumulator platform 48, are not shown in these figures for purposes of clarity. In addition to those components of the part of the frame 10 of the ice cream sandwich collating and packaging machine shown in FIGS.

Figure 8:
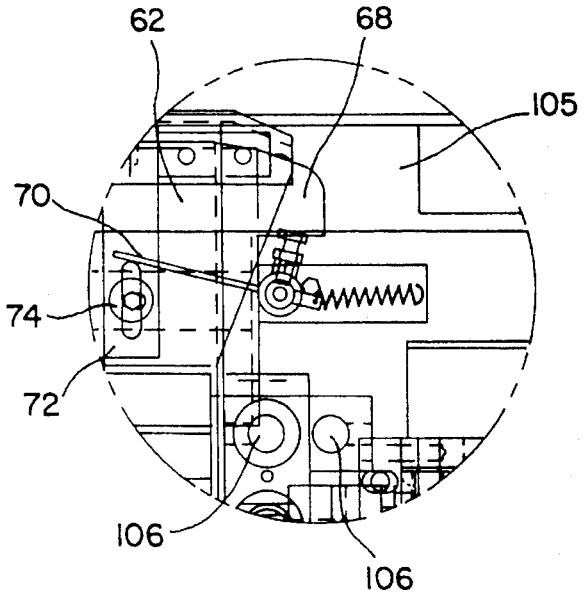
FIG. 8 is an enlarged view of a loader door assembly on the adjustable loader assembly shown in FIG. 4 taken within the circle designated B in FIG. 5.

1–3, a box rail 58, a frame bracket 60 for securing the box rail 58 to the frame panel 14, an angled loading wall 62, and a pair of brackets 64 with spacers 66 for securing the angled loading wall 62 to the box rail 58 are provided. Also provided are a loading surface 68 for supporting a pair of spring loaded loading gates 70 (see FIG. 8) and a pair of brackets 72 with spacers 74 for securing the loading surface 68 to the stationary strongback 16. The position of the spring loaded loading gate 70 located furthest downstream from the adjustable conveyor assembly 12 (i.e. the gate 70 not shown in FIG. 8) is adjustable on the loading surface 68 along a line substantially parallel to the first horizontal axis 50 so as to accommodate rows of differing numbers of ice cream sandwiches as will be described shortly in more detail.

It should be noted that in FIGS. 4–6 the accumulator platform 48 has mounted thereon a stop member 86 and a fiber optic sensor 88 for sensing the presence of an ice cream sandwich aligned against the stop member 86. As with the position of the adjustable spring loaded loading gate 70, the positions of the stop member 86 and the fiber optic sensor 88 are adjustable on the accumulator platform 48 along a line substantially parallel to the first horizontal axis 50 so as to accommodate rows of differing numbers of ice cream sandwiches as will be described shortly in more detail.

Figure 9:
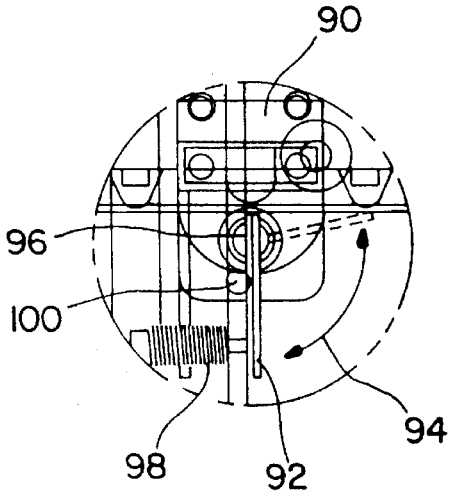
FIG. 9 is an enlarged view of a pivotal flap assembly on the adjustable loader assembly shown in FIG. 4 taken within the circle designated C in FIG. 6.

The adjustable loader assembly 56 comprises an upper ice cream sandwich pushing assembly 76, an ice cream sandwich elevator assembly 78, and a lower ice cream sandwich pushing assembly 80. The upper ice cream sandwich pushing assembly 76 comprises a pushing arm assembly 82 (see FIG. 9) which is mounted to a band cylinder assembly 84. The pushing arm assembly 82 comprises a pushing arm 90 upon which a pushing flap 92 is freely pivotally mounted. The pushing flap 92 is freely pivotal in a pivot direction 94 at an angle of substantially 90° about a pivot axis 96 between a vertical position (as shown) and a horizontal position (as proposed). The pushing flap 92 is supported in the vertical position during its forward travel first by a shock absorber 98, such as, for example an Endine shock absorber, so as to prevent the pushing flap 92 from bouncing over any newly accumulated ice cream sandwiches, and second by a stop member 100 so as to prevent backward movement out of the vertical position by pushing flap 92 upon engaging such sandwiches. Such an arrangement prevents excessive wear and tear on the pushing flap 92, and on the pushing arm assembly 82 in general.

The band cylinder assembly 84, which is typically a Tolomatic band cylinder kit, acts to move the pushing arm assembly 82 along a second substantially horizontal axis 102, that is substantially transverse to the first horizontal axis 50, between a beginning position (as shown) and an ending position next to an elevator platform 104 of the elevator assembly 78, which will be described shortly. When the pushing arm assembly 82 is moved forward from the beginning position and the ending position, the pushing flap 92 is in the vertical position so as to push an accumulated row of ice cream sandwiches along the second horizontal axis 102 onto the elevator platform 104. After the accumulated row of ice cream sandwiches have been pushed onto the elevator platform 104, the pushing arm assembly 82 is moved backward from the ending position to the beginning position. During this backward movement, the pushing flap 92, being freely pivotal between the vertical position and the horizontal position, may in some instances assume a substantially horizontal position by virtue of its own moment of inertia. Alternatively, the pushing flap 92 may engage and contact any additional ice cream sandwiches which may have accumulated on the accumulator platform 48, thereby forcing the pushing flap 92 into the horizontal position. Thus, during this backward movement, the pushing flap 92 may either pass freely over the tops of any additional ice cream sandwiches which may have accumulated on the accumulator platform 48, or the pushing flap 92 may slide across and thereby contact the tops of any additional ice cream sandwiches which may have accumulated on the accumulator platform 48. In any event, the pushing flap 92 rides out of the way of incoming ice cream sandwiches, as the term is intended, as it does not impede the orderly and uniform positioning and accumulation of additional ice cream sandwiches when the pushing arm assembly 82 is in the ending position or in the process of moving backward from the ending position to the beginning position. In this respect, pushing arm assembly 82 operates identically to the pusher means of commonly assigned U.S. Pat. No. 5,042,638 to Price, the disclosure of which is incorporated herein by reference.

It should be noted that the band cylinder assembly 84 is controlled by the PLC 52. This control is facilitated by having a proximity sensor (not shown) located at each end of the band cylinder assembly 84 so as to provide the PLC 52 with an indication of the position of the pushing arm assembly 82.

Figure 10:
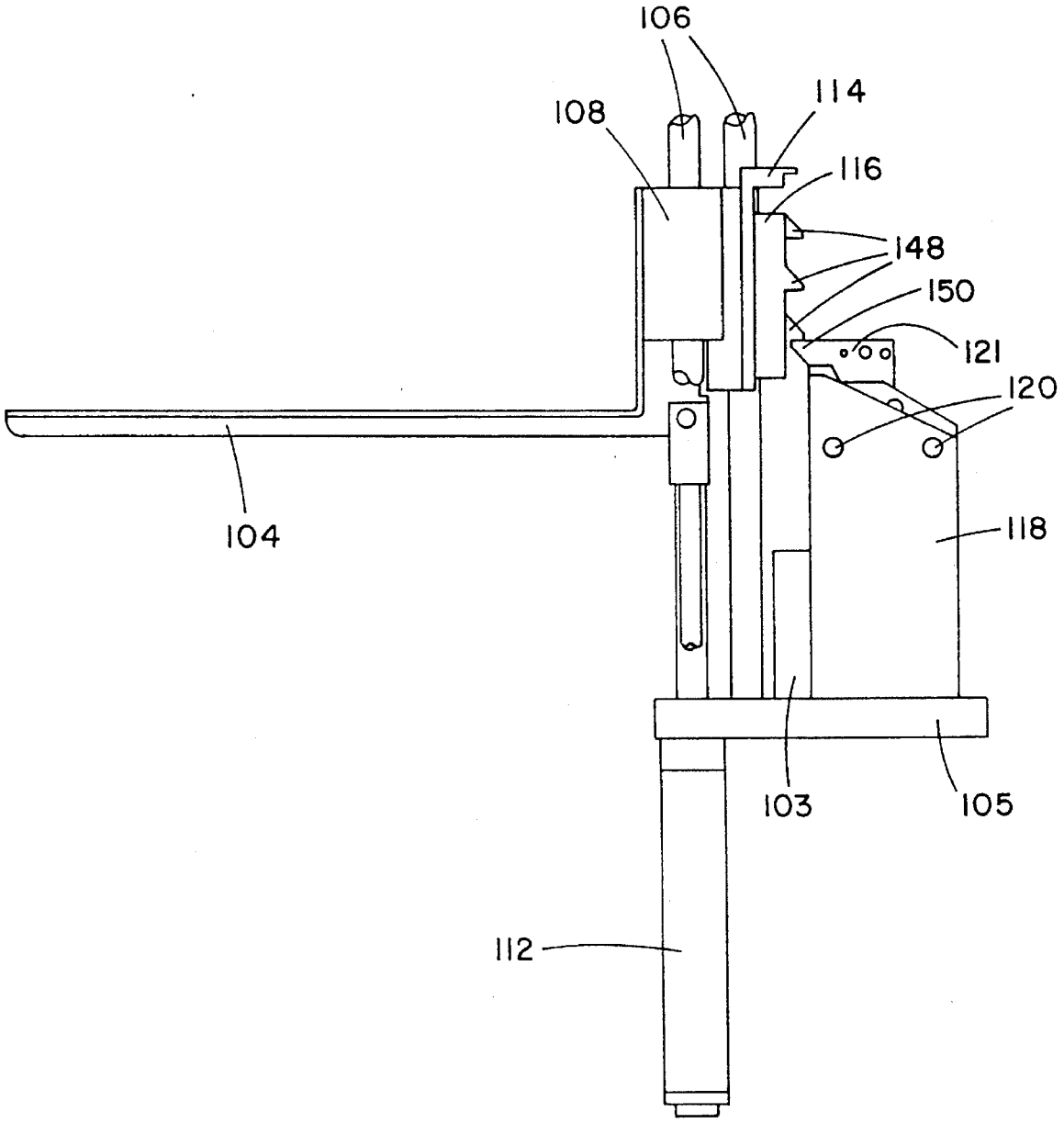
FIG. 10 is an isolated side view of several select components of the elevator assembly on the adjustable loader assembly shown in FIG. 4.

The ice cream sandwich elevator assembly 78 comprises a horizontal support member 105 secured between the frame panel 14 and the stationary strongback 16, a plurality of cylindrical elevator shafts 106 and a corresponding elevator shafts cap 107 mounted on the horizontal support member 105, a sliding elevator fixture 108 movable along a first substantially vertical axis 110 on the plurality of cylindrical elevator shafts 106, an elevator air cylinder 112 for moving the sliding elevator fixture 108 vertically on the plurality of cylindrical elevator shafts 106, a base stop post 103 mounted on the horizontal support member 105, the elevator platform 104, an angled top stop bracket 114, and a ratchet fixture 116. The elevator platform 104, the angled top stop bracket 114, and the ratchet fixture 116 are all secured to the sliding elevator fixture 108. FIG. 10 is an isolated side view of several of the foregoing described components of the elevator assembly 78. It should be noted that the elevator platform 104, the angled top stop bracket 114, and the ratchet fixture 116 may be integral with the sliding elevator fixture 108.

Figure 7:
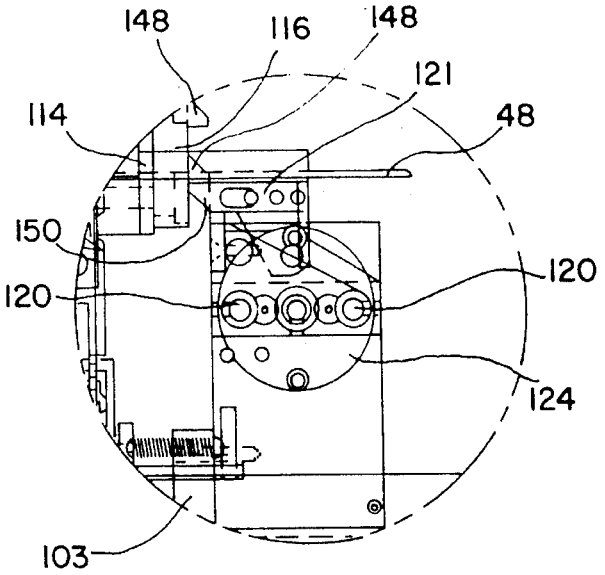
FIG. 7 is an enlarged view of an elevator assembly on the adjustable loader assembly shown in FIG. 4 taken within the circle designated A in FIG. 4.
Figure 11:
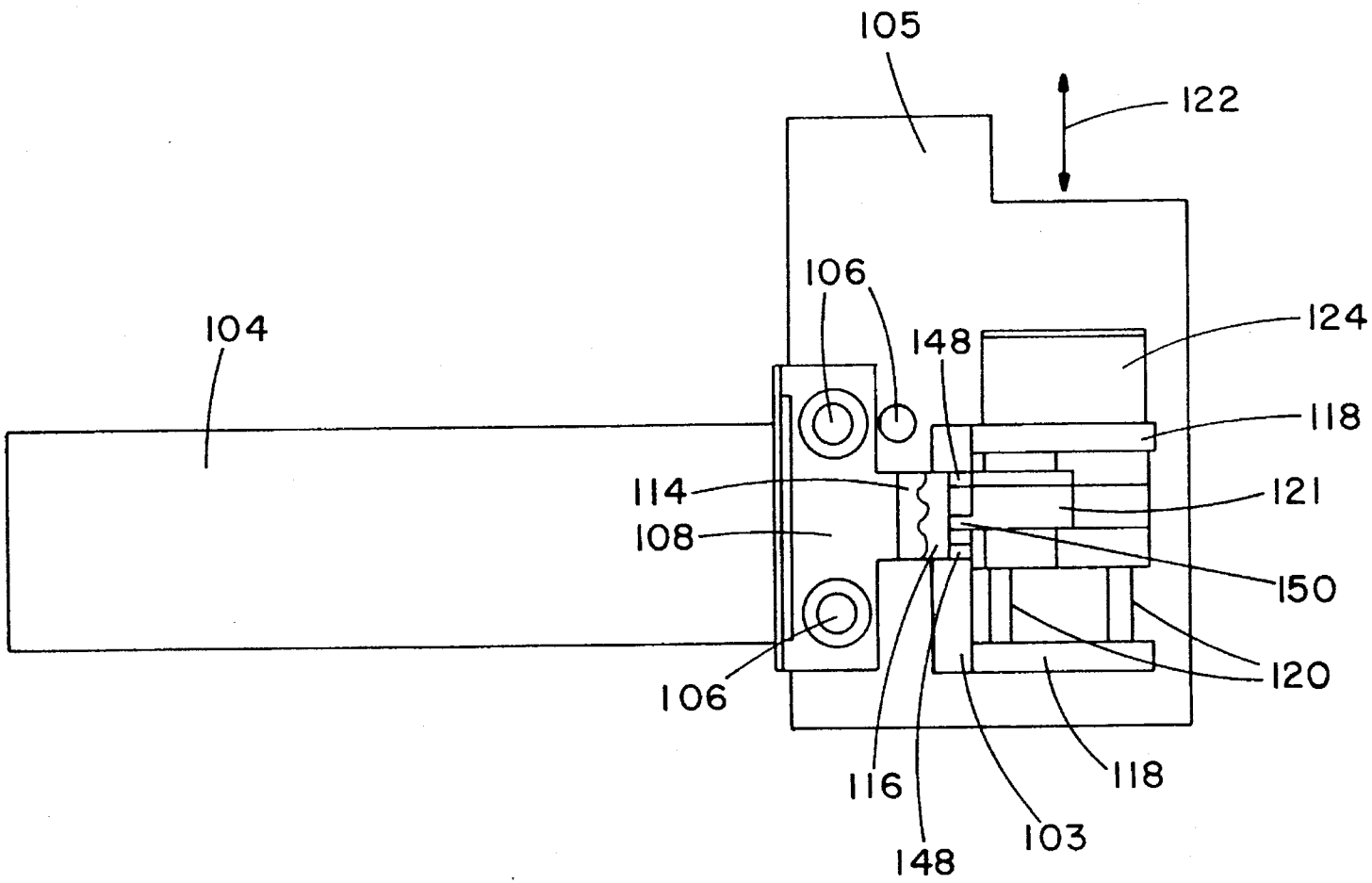
FIG. 11 is an isolated top view of several select components of the elevator assembly on the adjustable loader assembly shown in FIG. 5.

The ice cream sandwich elevator assembly 78 further comprises a pair of vertical support members 118 mounted on the horizontal support member 105, a pair of cylindrical transport shafts 120 mounted between the pair of vertical support members 118, a sliding dog fixture 121 movable along a third substantially horizontal axis 122, that is substantially parallel to the second horizontal axis 102, on the pair of cylindrical transport shafts 120, and a transport air cylinder 124 for moving the sliding dog fixture 121 horizontally on the pair of cylindrical transport shafts 120 (see FIG. 7). FIG. 11 is an isolated top view of several of the foregoing described components of the elevator assembly 78.

An essential feature of the ice cream sandwich elevator assembly 78 is the interaction between the sliding dog fixture 121 and the angled top stop bracket 114 and the ratchet fixture 116. The ratchet fixture 116 has a plurality of vertically and horizontally staggered ratchet extensions 148 protruding therefrom, and the sliding dog fixture 121 has at least one narrow support extension 150 protruding therefrom. These ratchet extensions 148 and the angled top stop bracket 114 are supported by the narrow support extensions 150 depending upon the position of the sliding dog fixture 121. It should be noted that the control panel 54 allows a user to select the number of rows of ice cream sandwiches which may be stacked on the elevator platform 104. The PLC 52 accepts this control panel input and controls the position of the sliding dog fixture 121, and hence the position of the narrow support extensions 150 under the angled top stop bracket 114 and the plurality of staggered ratchet extensions 148. It should also be noted that although three staggered ratchet extensions 148 are shown, thereby allowing four rows of ice cream sandwiches to be stacked, a ratchet fixture 116 having additional staggered ratchet extensions 148 may be utilized so as to allow additional rows of ice cream sandwiches to be stacked. It should further be noted that the sliding dog fixture 121 is provided with an adjustable narrow support extension (which is hidden in FIG. 11 by one of the staggered ratchet extensions 148) that is movable between engaging and disengaging positions with respect to the staggered ratchet extensions 148.

In addition to the foregoing described components of the ice cream sandwich elevator assembly 78, an overhead bracket 138 is secured between the elevator shafts cap 107 and a housing 140 covering the upper and lower ice cream sandwich pushing assemblies 76,80. Secured under the overhead bracket 138 is a sliding stop holder 142 for slidably accommodating a sliding stop 144. The sliding stop 144 is movable with the elevator platform 104 along a second substantially vertical axis 146, substantially parallel to the first vertical axis 110. The position of the sliding stop holder 142 is adjustable on the overhead bracket 138 along a line substantially parallel to the first horizontal axis 50 so as to accommodate rows of differing numbers of ice cream sandwiches as will be described shortly in more detail.

As previously stated, the ice cream sandwich elevator assembly 78 is controlled by the PLC 52. This operation is facilitated by having proximity sensors (not shown) located at one end of the transport shafts 120 and near the bottom of the elevator shafts 106. One of these proximity sensors provides the PLC 52 with an indication of the position of the sliding dog fixture 121. The other of these proximity sensors provides the PLC 52 with an as to whether the elevator platform 104 has reached a position adjacent the loading surface 68.

The lower ice cream sandwich pushing assembly 80 comprises a pushing arm assembly 126 which is mounted to a band cylinder assembly 128. The pushing arm assembly 126 comprises a pushing arm 130 upon which a pushing block 132 is fixedly mounted. The band cylinder assembly 128, which is typically a Tolomatic band cylinder kit, acts to move the pushing arm assembly 126 along a fourth substantially horizontal axis 134, that is substantially parallel to the third horizontal axis 122, between a starting position (as shown) and a finishing position wherein the pushing block 132 is located between the angled loading wall 62 and the loading surface 68, such that the face of the pushing block 132 is substantially aligned with the vertical surfaces on the stationary strongback 16 and the box rail 58. When the pushing arm assembly 126 is moved forward from the starting position to the finishing position, the pushing block 132 pushes stacked rows of ice cream sandwiches along the fourth horizontal axis 134, off the elevator platform 104 and onto the loading surface 68 through the pair of spring loaded loading gates 70, and out through an opening 136 between the stationary strongback 16 and the box rail 58 for loading into a packaging box (not shown). After the stacked rows of ice cream sandwiches have been pushed out through the opening 136, the elevator platform 104 is moved upward and the pushing arm assembly 126 is moved backward over the loading surface 68 and under elevator platform 104 from the finishing position to the starting position.

It should be noted that the band cylinder assembly 128 is controlled by the PLC 52. This control may be facilitated by having a proximity sensor (not shown) located at each end of the band cylinder assembly 128 so as to provide the PLC 52 with an indication of the position of the pushing arm assembly 126.

With the adjustable conveyor assembly 12 and the adjustable loader assembly 56 now fully described, their joint operation will now be described.

First, the position of the stop member 86, the fiber optic sensor 88, the sliding stop holder 142, and the adjustable spring loaded loading gate 70 are must be set for a predetermined number of ice cream sandwiches in a row. Next, the number of rows of ice cream sandwiches to be stacked must be inputted at the control panel 54. Lastly, the guide rails 44 on the adjustable conveyor assembly 12 are adjusted so as to accommodate the width of the present ice cream sandwiches. It should be noted that the conveying speed of the conveyor belt 40 may also be adjusted. The adjustable conveyor assembly 12 is now ready to convey ice cream sandwiches, and the adjustable loader assembly 56 is now ready to accept the conveyed ice cream sandwiches. It should be noted that the number of rows of ice cream sandwiches to be stacked may also be determined by moving the adjustable narrow support extension on the sliding dog fixture 121 into an engaging or disengaging position.

The adjustable conveyor assembly 12 conveys ice cream sandwiches along the first substantially horizontal axis 50 onto the accumulator platform 48. When the predetermined number of ice cream sandwiches accumulate in a row on the accumulator platform 48, the first ice cream sandwich in the row becomes aligned against the stop member 86 and the fiber optic sensor 88 signals the PLC 52. The PLC 52, instructed by the proximity sensors that the pushing arm assembly 82 is in the beginning position, then commands the band cylinder assembly 84 to move the pushing arm assembly 82 to the ending position.

At this point, the elevator platform 104 is adjacent the accumulator platform 48 so that the pushing flap 92 slides the row of ice cream sandwiches directly onto the elevator platform 104 against the angled loading wall 62. This position of the elevator platform 104 corresponds to the elevator air cylinder 112 having forced the sliding elevator fixture 108 to its highest point, nearly up against the elevator shafts cap 107.

Next, the PLC 52, instructed by the proximity sensors that the pushing arm assembly 82 is in the ending position, commands the band cylinder assembly 84 to move the pushing arm assembly 82 back to the beginning position in the manner described above. At this point, the elevator platform 104 is lowered a certain distance, by the interaction between the sliding dog fixture 121 and the rachet fixture 116 and the angled top stop bracket 114, depending on the number of rows of ice cream sandwiches that were selected to be stacked. The rows of ice cream sandwiches are stacked one over the other in the manner just described until the elevator platform 104 is lowered to the level of the loading surface 68 where the stacked rows of ice cream sandwiches are pushed by the pushing block 132 from the elevator platform 104 into the packaging box, as previously described. The cycle is then repeated.

The present invention is not to be limited in scope by the specific embodiment described herein. Indeed, various modifications of the present invention, in addition to those described herein, will be apparent to those of skill in the art from the foregoing description and accompanying drawings.

Thus, such modifications are intended to fall within the scope of the appended claims. Additionally, various references are cited throughout the specification, the disclosures of which are each incorporated herein by reference in their entirety.

What is claimed is:

1. An apparatus for collating wrapped ice cream sandwiches for packaging, said apparatus comprising:

a substantially horizontal accumulator platform;

conveying means for conveying the wrapped ice cream sandwiches along a first substantially horizontal axis onto the accumulator platform;

detecting means for detecting when a predetermined number of the conveyed ice cream sandwiches have accumulated on the accumulator platform;

an elevator assembly disposed adjacent the accumulator platform, the elevator assembly having a substantially horizontal elevator platform that is movable along a substantially vertical axis;

mounting means disposed above the accumulator platform, the mounting means being movable along a second substantially horizontal axis between a beginning position and an ending position, the second horizontal axis being substantially transverse to the first horizontal axis;

pushing means mounted to the mounting means for pushing the predetermined number of conveyed ice cream sandwiches from the accumulator platform onto the elevator platform when the mounting means moves forward from the beginning position to the ending position; and control means for controlling the horizontal movement of the mounting means and the vertical movement of the elevator platform.

2. The apparatus as defined in claim 1, wherein the accumulator platform supports a stop member for stopping the conveyed ice cream sandwiches on the accumulator platform, and wherein the position of the stop member is adjustable on the accumulator platform along a line substantially parallel to the first horizontal axis so as to stop differing predetermined numbers of conveyed ice cream sandwiches.

3. The apparatus as defined in claim 1, wherein the conveying means is width-adjustable so as to allow wrapped ice cream sandwiches of differing widths to be conveyed onto the accumulator platform.

4. The apparatus as defined claim 1, wherein the detecting means is a fiber optic sensor, wherein the fiber optic sensor is mounted on the accumulator platform, and wherein the position of the fiber optic sensor is adjustable on the accumulator platform along a line substantially parallel to the first horizontal axis so as to detect differing predetermined numbers of ice cream sandwiches.

5. The apparatus as defined in claim 1, wherein the elevator assembly comprises a sliding elevator fixture that is movable along the substantially vertical axis, the elevator platform which is secured to the sliding elevator fixture, a ratchet fixture secured to the sliding elevator fixture, and a sliding dog fixture disposed adjacent the sliding elevator fixture that is movable along a third substantially horizontal axis, the third horizontal axis being substantially parallel to the second horizontal axis, wherein the ratchet fixture has a plurality of vertically and horizontally staggered ratchet extensions protruding therefrom and the sliding dog fixture has at least one narrow support extension protruding therefrom, and wherein the ratchet extensions are supported by the at least one narrow support extension depending upon the position of the sliding dog fixture.

6. The apparatus as defined in claim 5, wherein the elevator assembly further comprises an elevator air cylinder for forcing the sliding elevator fixture upwards along the substantially vertical axis, and a transport air cylinder for moving the sliding dog fixture along the third substantially horizontal axis.

7. The apparatus as defined in claim 6, wherein the control means also controls the horizontal movement of the sliding dog fixture.

8. The apparatus as defined in claim 1, wherein the elevator assembly comprises a sliding elevator fixture that is movable along the substantially vertical axis, and a sliding dog fixture disposed adjacent the sliding elevator fixture that is movable along a third substantially horizontal axis, the third horizontal axis being substantially parallel to the second horizontal axis, wherein the sliding elevator fixture has formed integrally therein the elevator platform and a plurality of vertically and horizontally staggered ratchet extensions, wherein the sliding dog fixture has at least one narrow support extension protruding therefrom, and wherein the ratchet extensions are supported by the at least one narrow support extension depending upon the position of the sliding dog fixture.

9. The apparatus as defined in claim 8, wherein the elevator assembly further comprises an elevator air cylinder for forcing the sliding elevator fixture upwards along the substantially vertical axis, and a transport air cylinder for moving the sliding dog fixture along the third substantially horizontal axis.

10. The apparatus as defined in claim 9, wherein the control means also controls the horizontal movement of the sliding dog fixture.

11. The apparatus as defined in claim 1, further comprising a band cylinder for moving the mounting means along the second substantially horizontal axis between the beginning position and the ending position.

12. The apparatus as defined in claim 1 wherein said pushing means is adapted to be freely pivotally movable between a substantially vertical position and a substantially horizontal position, and said pushing means assumes said substantially vertical position for pushing said conveyed ice cream sandwiches from said accumulator platform onto said elevator platform.

13. The apparatus as defined in claim 12, wherein said pushing means is adapted to deflect toward said substantially horizontal position for either passing or making sliding contact with any additionally accumulated ice cream sandwiches when said mounting means moves backward from said ending position to said beginning position.

14. The apparatus as defined in claim 1, wherein the control means also controls the conveying speed of the conveying means.

15. The apparatus as defined in claim 1, wherein the control means comprises a programmable logic controller (PLC) having a control panel for allowing a user to interface therewith.

16. An apparatus for collating wrapped ice cream sandwiches for packaging, said apparatus comprising:

a substantially horizontal accumulator platform;

conveying means for conveying the wrapped ice cream sandwiches along a first substantially horizontal axis onto the accumulator platform;

detecting means for detecting when a predetermined number of the conveyed ice cream sandwiches have accumulated on the accumulator platform;

an elevator assembly disposed adjacent the accumulator platform, the elevator assembly having a substantially horizontal elevator platform that is movable along a substantially vertical axis;

mounting means disposed above the accumulator platform, the mounting means being movable along a second substantially horizontal axis between a beginning position and an ending position, the second horizontal axis being substantially transverse to the first horizontal axis;

pushing means mounted to the mounting means for pushing the predetermined number of conveyed ice cream sandwiches from the accumulator platform onto the elevator platform when the mounting means moves forward from the beginning position to the ending position; and control means for controlling the horizontal movement of the mounting means and the vertical movement of the elevator platform.

17. The apparatus as defined in claim 16, wherein the accumulator platform supports a stop member for stopping the conveyed ice cream sandwiches on the accumulator platform, and wherein the position of the stop member is adjustable on the accumulator platform along a line substantially parallel to the first horizontal axis so as to stop differing predetermined numbers of conveyed ice cream sandwiches.

18. The apparatus as defined in claim 16, wherein the conveying means is width-adjustable so as to allow wrapped ice cream sandwiches of differing widths to be conveyed onto the accumulator platform.

19. The apparatus as defined in claim 16, wherein the detecting means is a fiber optic sensor, wherein the fiber optic sensor is mounted on the accumulator platform, and wherein the position of the fiber optic sensor is adjustable on the accumulator platform along a line substantially parallel to the first horizontal axis so as to detect differing predetermined numbers of ice cream sandwiches.

20. The apparatus as defined in claim 16, wherein the elevator assembly comprises a sliding elevator fixture that is movable along the substantially vertical axis, the elevator platform which is secured to the sliding elevator fixture, a ratchet fixture secured to the sliding elevator fixture, and a sliding dog fixture disposed adjacent the sliding elevator fixture that is movable along a third substantially horizontal axis, the third horizontal axis being substantially parallel to the second horizontal axis, wherein the ratchet fixture has a plurality of vertically and horizontally staggered ratchet extensions protruding therefrom and the sliding dog fixture has at least one narrow support extension protruding therefrom, and wherein the ratchet extensions are supported by the at least one narrow support extension depending upon the position of the sliding dog fixture.

21. The apparatus as defined in claim 20, wherein the elevator assembly further comprises an elevator air cylinder for forcing the sliding elevator fixture upwards along the substantially vertical axis, and a transport air cylinder for moving the sliding dog fixture along the third substantially horizontal axis.

22. The apparatus as defined in claim 21, wherein the control means also controls the horizontal movement of the sliding dog fixture.

23. The apparatus as defined in claim 16, wherein the elevator assembly comprises a sliding elevator fixture that is movable along the substantially vertical axis, and a sliding dog fixture disposed adjacent the sliding elevator fixture that is movable along a third substantially horizontal axis, the third horizontal axis being substantially parallel to the second horizontal axis, wherein the sliding elevator fixture has formed integrally therein the elevator platform and a plurality of vertically and horizontally staggered ratchet extensions, wherein the sliding dog fixture has at least one narrow support extension protruding therefrom, and wherein the ratchet extensions are supported by the at least one narrow support extension depending upon the position of the sliding dog fixture.

24. The apparatus as defined in claim 23, wherein the elevator assembly further comprises an elevator air cylinder for forcing the sliding elevator fixture upwards along the substantially vertical axis, and a transport air cylinder for moving the sliding dog fixture along the third substantially horizontal axis.

25. The apparatus as defined in claim 16 wherein said pushing means is adapted to be freely pivotally movable between a substantially vertical position and a substantially horizontal position, and said pushing means assumes said substantially vertical position for pushing said conveyed ice cream sandwiches from said accumulator platform onto said elevator platform.

26. The apparatus as defined in claim 25, wherein said pushing means is adapted to deflect toward said substantially horizontal position for either passing or making sliding contact with any additionally accumulated ice cream sandwiches when said mounting means moves backward from said ending position to said beginning position.

27. The apparatus as defined in claim 24, wherein the control means also controls the horizontal movement of the sliding dog fixture.

28. The apparatus as defined in claim 16, further comprising a band cylinder for moving the mounting means along the second substantially horizontal axis between the beginning position and the ending position.

29. The apparatus as defined in claim 16, wherein the control means also controls the conveying speed of the conveying means.

30. The apparatus as defined in claim 16, wherein the control means comprises a programmable logic controller (PLC) having a control panel for allowing a user to interface therewith.

* * * * *